US008052014B2

(12) United States Patent
Hasegawa et al.

(10) Patent No.: US 8,052,014 B2
(45) Date of Patent: Nov. 8, 2011

(54) FLUID CONTAINER

(75) Inventors: Toru Hasegawa, Kanagawa (JP); Toshiki Takedutsumi, Kanagawa (JP)

(73) Assignee: Tokyo Ohka Kogyo Co., Ltd., Kanagawa (JP)

( * ) Notice: Subject to any disclaimer, the term of this patent is extended or adjusted under 35 U.S.C. 154(b) by 674 days.

(21) Appl. No.: 12/161,632

(22) PCT Filed: Nov. 2, 2006

(86) PCT No.: PCT/JP2006/322019

§ 371 (c)(1), (2), (4) Date: Nov. 3, 2008

(87) PCT Pub. No.: WO2007/088659

PCT Pub. Date: Aug. 9, 2007

(65) Prior Publication Data

US 2009/0184133 A1 Jul. 23, 2009

(30) Foreign Application Priority Data

Jan. 31, 2006 (JP) ..... 2006-023762

(51) Int. Cl.
*B65D 35/28* (2006.01)

(52) U.S. Cl. ..... 222/400.7; 222/464.1; 222/95; 222/105; 222/386.5; 137/212

(58) Field of Classification Search ..... 222/400.7, 222/400.8, 464.1, 95, 105, 386.5; 137/212
See application file for complete search history.

(56) References Cited

U.S. PATENT DOCUMENTS

| | | | | | |
|---|---|---|---|---|---|
| RE27,626 | E | * | 4/1973 | Johnston | 222/400.7 |
| 4,736,926 | A | * | 4/1988 | Fallon et al. | 251/149.9 |
| 4,785,973 | A | * | 11/1988 | Kobe | 222/82 |
| 5,435,460 | A | * | 7/1995 | Osgar | 222/1 |
| 5,957,328 | A | * | 9/1999 | Osgar | 222/1 |
| 5,971,019 | A | * | 10/1999 | Imai | 137/614.04 |
| 6,015,068 | A | * | 1/2000 | Osgar et al. | 222/400.7 |

(Continued)

FOREIGN PATENT DOCUMENTS

| | | |
|---|---|---|
| JP | 6100087 | 4/1994 |
| JP | 11059726 | 3/1999 |

(Continued)

OTHER PUBLICATIONS

International Search Report for PCT/JP2006/322019, completed Dec. 4, 2006.

*Primary Examiner* — Kevin P Shaver
*Assistant Examiner* — Donnell Long
(74) *Attorney, Agent, or Firm* — Hoffmann & Baron, LLP

(57) ABSTRACT

A dual storage system-type fluid container in which a liquid pouring tube is securely fitted and a liquid discharging passage formed in a dispenser is easily and securely connected to the liquid pouring tube. A joint for the fluid container comprises a flexible bag (12) having a neck part (11) opened such that liquid can be poured through it and also has an outer container (13) for receiving the bag (12) with the neck part (11) supported by a mouth part (13*a*). The liquid pouring tube (15) having a flange part (15*a*) can be fitted to the mouth part (13*a*) of the outer container (13) with a retainer (14) placed between the tube and the mouth part. A flow passage (21*a*) formed in the dispenser (2) can be directly connected to the fluid passage (15*b*) of the liquid pouring tube (15).

10 Claims, 6 Drawing Sheets

U.S. PATENT DOCUMENTS

| | | | | |
|---|---|---|---|---|
| 6,302,148 | B1 * | 10/2001 | Imai | 137/614.04 |
| 6,505,863 | B2 * | 1/2003 | Imai | 285/316 |
| 6,634,396 | B2 * | 10/2003 | Ozawa | 141/326 |
| 7,819,381 | B2 * | 10/2010 | Abe | 251/144 |

FOREIGN PATENT DOCUMENTS

| | | |
|---|---|---|
| JP | 2001192009 | 7/2001 |
| JP | 2001192099 | 7/2001 |
| JP | 2003172487 | 6/2003 |

* cited by examiner

FLUID CONTAINER

CROSS-REFERENCE TO RELATED APPLICATIONS

This application is the National Stage of International Application No, PCT/JP2006/322019, filed Nov. 2, 2006, which claims the benefit of Japanese Application No. 2006-023762, filed Jan. 31, 2006, the contents of which is incorporated by reference herein in their entirety.

FIELD OF THE INVENTION

The present invention relates to a container for storing, transporting and distributing fluids such as chemicals for the electronics industry. Particularly, the present invention relates to a fluid container provided with a joint for draining fluids.

BACKGROUND OF THE INVENTION

For example, chemicals for the electronics industry such as photo-resist are stored in a chemical container for transport, and are delivered to a factory. Such a chemical container is used in a linking configuration by which the same container is repeatedly used, or in a one way configuration by which a new container is used each time. Particularly, it is preferable to use the container in the one way mode in order not to affect the degree of purity of a high-purity chemical; however, the one way mode has an economic disadvantage. In recent years, a dual storage system-type container, which combines both of the above described modes, has been popular.

Generally, the dual storage system-type container has a bag (pouch) consisting of a flexible film which has been washed in advance. This film bag is formed of an inert material and is provided in an outer container. After the chemical is drained from the film bag, this film bag is disposed of, and a new film bag is filled with a chemical. The outer container including the joint and the like is used repeatedly.

In a way such as a dual storage system-type container, a container for liquid chemicals has been invented, which makes it possible to safely and securely drain liquid chemicals (for example, see Patent Document 1).

Patent Document 1: Japanese Unexamined Patent Application Publication No. H06-100087

SUMMARY OF THE INVENTION

FIG. 5 is a cross-sectional view of the top end of the container according to Patent Document 1, in a state in which a cap is attached. FIG. 5 of the present application corresponds to FIG. 3 of Patent Document 1. In addition, FIG. 6 is a cross-sectional view of the top edge of the container according to Patent Document 1, in a state in which the container and the dispenser are assembled. FIG. 6 of the present application corresponds to FIG. 6 of Patent Document 1.

In FIG. 5 and FIG. 6, the container according to Patent Document 1 includes a container 7 and a dispenser 8. The container 7 includes an outer container 716 having a port (hereinafter referred to as a mounting body) 718, a liquid pouring tube 722 having a fluid passage 780, and a coupling 724. The coupling 724 is provided at a top edge of a tube 794 so that the coupling 724 is inserted into the mounting body 718. The coupling 724 has a void space 776 provided at the top edge thereof, and a fluid passage that connects the void space 776 to a fluid passage 780 of the tube 794.

The container 7 further includes a ventilation passage 782 that ventilates gas between the inside of the outer container

716 and the void space 776, and a breakable seal 727 that is provided on the top end of the mounting body 718. The dispenser 8 can be inserted into the void space 790 through the seal 727, and includes a probe 846 having a fluid passage 844. Moreover, a compressed fluid passage is provided, which is connected to the probe 846, and which accommodates liquid chemicals that are drained from the outer container 716 through the tube 794, the coupling 724, and the fluid passage 844 of the probe 846.

In FIG. 5 and FIG. 6, the outer container 716 has a mouth portion 730 on which external threads are formed, and a retainer 719 and the mounting body 718 are attached inside the mouth portion 730. The container 7 is provided with a bag 720 consisting of a flexible film inside the outer container 716. After the mounting body 718, to which the bag 720 has been attached, is attached to the mouth portion 730 of the outer container 716, the bag 720 is inflated, preferably with nitrogen or compressed air, before the bag 720 is filled with liquid chemicals. Subsequently, the bag 720 is filled with the liquid chemicals through the mounting body 718. Thereafter, the liquid pouring tube 722 and the coupling 724 of the liquid pouring tube 722 are inserted into the mounting body 718. A cover 726 positions a breakable seal 727 on the top end of the mounting body 718, thereby sealing the void space 776. Moreover, it is possible to cover the breakable seal 727 by providing a cap 728 to the mouth portion 730 of the container 7.

During the transport and handling of the container 7, all of the gas generated in the flexible bag 720 can flow through a gas passage formed by the coupling 724 of the liquid pouring tube 722, and can stay in the void space 776 that is provided on the top edge of the coupling 724 of the liquid pouring tube 722.

The container 7 according to Patent Document 1 includes the breakable seal 727. Accordingly, the probe 846 provided in the dispenser 8 breaks through the seal 727, thereby making it possible to insert the probe 846 into the void space 790 (see FIG. 6). However, there is a problem at this time in which fracture pieces of the seal 727 may mix in the bag 720 through the void space 790 (see FIG. 5). Moreover, there has been concern regarding a case in which an operator can not properly break through the seal, causing clogging of the probe, thereby disabling the connection. It is possible to eliminate the aforementioned problem by achieving a structure by which the dispenser is connected to the container without the use of a breakable seal. In addition, it is more preferable if a one-touch connection to the container is made possible without threading to the dispenser.

Moreover, the container 7 according to Patent Document 1 is an assembly in which the liquid pouring tube 722 and the coupling 724 are configured as separate units and in which one end of the liquid pouring tube 722 is pressed into to the coupling 724 (see FIG. 5). This liquid pouring tube 722 with the coupling 724 is reused after cleaning; however, there has been trouble in reassembling (press fitting) after disassembling and cleaning in order to remove chemicals that have seeped into the gaps of the press fit points. It is possible to eliminate such trouble by integrating the coupling and the liquid pouring tube into one body.

In addition, in FIG. 5 and FIG. 6, an edge 787 is formed on a top edge of the coupling 724 as a diameter which is slightly larger than the external diameter of the coupling 724. Accordingly, there has been a risk in the tube 722 with the coupling 724 getting past a step provided to the void space 776 of the mounting body 718, thereby falling into the bag 720. A structure is demanded which makes it possible to easily attach the liquid pouring tube to the container independent of operator adjusting the force. However, these are the problems to be resolved by the present invention.

The present invention has been made in view of such problems. It is an object of the present invention to provide a dual storage system-type fluid container, which includes a bag made of a flexible film inside an outer container, to which a liquid pouring tube can be securely attached, and in which a liquid discharging passage formed in a dispenser is easily and securely connected to the liquid pouring tube.

The inventors have configured a liquid container such that a liquid pouring tube having a collar portion can be attached to a mouth portion of an outer container through a retainer, and further configured the liquid container such that a duct provided to a dispenser can be directly connected to a fluid passage of the liquid pouring tube. Based on this, the inventors have invented the following new liquid container.

In a first aspect of the present invention, a fluid container is provided which includes: a flexible bag having a neck portion that is open for making it possible to pour liquid; and an outer container that supports the neck portion with a mouth portion and that accommodates the bag, in which the fluid container further includes: a cylindrical retainer held by the mouth portion, the retainer having a substantially cylindrical header portion protruding from a cylindrical bottom at a first end, a cylindrical portion fitting into an orifice of the neck portion at a second end, and a through hole penetrating from the first end to the second end; a liquid pouring tube having a collar portion adhered to a top face of the header portion at the first end, with the second end being inserted into the through hole, in which the liquid pouring tube has a fluid passage extending from the first end to the second end, and in which liquid in the bag is drained through the fluid passage; a first ventilating means for ventilating gas from an inside of the outer container to the mouth portion, in which the first ventilating means has a plurality of first orifices provided at a bottom of the neck portion, the plurality of first orifices communicating from an inside of the outer container to an inside of the neck portion, and has a plurality of second orifices communicating from a perimeter of the cylindrical portion to the top face of the header portion; a second ventilating means for ventilating gas from the inside of the bag to the mouth portion, in which the second ventilating means has a plurality of third orifices provided to the collar portion, the plurality of third orifices communicating from the mouth portion to an inside of the through hole; and a sealing means for sealing the mouth portion, in which, when the sealing means is attached, the sealing means prevents both liquid and gas from flowing out of the mouth portion, and when the sealing means is removed, gas in the outer container and gas in the bag escape, respectively, through the first and second ventilating means to an outside of the mouth portion, before liquid in the liquid pouring tube is drained to the mouth portion.

According to the first aspect of the present invention, the fluid container includes a flexible bag and an outer container. The bag has a neck portion that is open for making it possible to pour liquid. The outer container makes it possible to accommodate the bag with the neck portion supported by a mouth portion.

The bag is configured with a pouch of a flexible film formed with an inert material and the neck portion consisting of relatively rigid synthetic resins, in which the neck portion is bonded to an end portion of the pouch. The bag is washed in advance, and is accommodated in the outer container. After draining the liquid from the bag, the bag with the neck portion is discarded, and a new bag with a neck portion is accommodated in the outer container. This fluid container is a dual storage system-type container, in which the outer container is repeatedly used, and in which a new bag is used every time.

It is preferable that the outer container be constructed with a strong material in order to make it possible to be used repeatedly. By way of such an outer container, it is possible to use a metal drum which is made by forming and welding stainless steel; however, it is not limited to a metal drum, and other materials including a synthetic resin may be used. A steel storage drum is preferably used as the outer container, the steel storage drum being configured with a base plate, a side wall with a bracelet, and a top plate which bulges in the middle thereof. As for the outer container, external threads are formed on the mouth portion (also referred to as mouth plug), and a pair of molded handles may be provided thereto to facilitate transport.

Here, a flange is formed at an orificial side of the neck portion, while a step is provided at an inner wall of the mouth portion, and this flange engages with the step, thereby supporting the neck portion to the mouth portion. The bag is accommodated in the outer container, the neck portion attached to the bag is supported by the mouth portion of the outer container, and thereafter, the bag is expanded preferably with nitrogen or compressed air. Subsequently, liquid is poured through an orifice of the neck portion into the bag.

Moreover, the fluid container according to the first aspect of the present invention includes a cylindrical retainer and a liquid pouring tube. The retainer is held to the mouth portion. Moreover, the retainer has a substantially cylindrical header portion in a first end, and has a cylindrical portion in a second end. In addition, the retainer has a through hole penetrating from the first end to the second end. The header portion protrudes from within a cylindrical bottom of the retainer. The cylindrical portion fits in the orifice of the neck portion. The liquid pouring tube has, in the first end thereof, a collar portion adhered to a top face of the header portion. Moreover, the second end of the liquid pouring tube is inserted into the through hole of the retainer. The liquid pouring tube has a fluid passage extending from the first end to the second end, and the liquid in the bag is drained through the fluid passage.

The external diameter of the retainer is slightly smaller than the inner diameter of the neck portion, and the retainer fits in the neck portion supported by the mouth portion. A flange, which has an external diameter that is slightly smaller than the inner diameter of the mouth portion, is provided to a first end of the retainer, and an O-ring may be supported by this flange, thereby sealing up the mouth portion. A cover, which is to be described later, is fastened to the mouth portion, thereby holding the retainer in the mouth portion together with the neck portion. A predetermined gap is provided between a bottom external wall of the retainer and a bottom inner wall of the mouth portion. As a result, it is possible to ventilate gas between first orifices (to be described later) provided at the bottom of the neck portion and second orifices (to be described later) provided at the retainer.

The cylindrical portion protrudes from the bottom of the retainer, and the cylindrical portion fits in the orifice of the neck portion. For example, an O-ring is supported inside the orifice of the neck portion, and this O-ring adheres to the outer perimeter of the cylindrical portion, thereby making it possible to seal the gas in the bag. The fact that the through hole penetrates from the first end to the second end of the retainer indicates that the through hole penetrates from the top edge of the header portion to the bottom edge of the cylindrical portion, and the liquid pouring tube is inserted into this through hole. In order to make it possible to ventilate gas through third orifices (to be described later), a gap is preferably provided between the through hole and the outer perimeter of the liquid pouring tube.

The fluid container according to the first aspect of the present invention includes a first ventilating means for ventilating air from the inside of the outer container to the mouth portion; a second ventilating means for ventilating air from the inside of the bag to the mouth portion; and a sealing means for sealing the mouth portion. The first ventilating means has the plurality of first orifices and the plurality of second orifices. The plurality of first orifices is provided at the bottom of the neck portion and communicates the inside of the outer container to the inside of the neck part. The plurality of second orifices communicates the perimeter of the cylindrical portion to the top face of the header portion. The second ventilating means has the plurality of third orifices. These third orifices are provided to the collar portion of the liquid pouring tube, and communicate the mouth portion to the inside of the through hole of the retainer.

The liquid container according to the first aspect of the present invention prevents, when the sealing means is attached thereto, both liquid and gas from flowing out of the mouth portion. Moreover, when the sealing means is removed, the gas in the outer container and the gas in the bag escape through the first and second ventilating means, respectively, to the outside, before the liquid in the liquid pouring tube is drained to the mouth portion.

The first orifices may be through holes formed at the bottom of the neck portion, and are provided around the orifices of the neck part into which the cylindrical portion is inserted. The first orifices substantially communicate the internal space of the outer container to the gap provided between the retainer and the mouth portion. The second orifices may be slits penetrating from the perimeter of the cylindrical portion to the top face of the header portion, and are provided between the cylindrical portion and the header portion. The second orifices substantially communicate the gap, which is provided between the retainer and the neck portion, to atmospheric air.

The third orifices may be through holes formed at the collar portion of the liquid pouring tube, and penetrate from the top surface of the collar portion to the perimeter of the tube. For example, the O-ring is supported on the under surface of the collar portion, and this O-ring adheres to the top face of the header portion, thereby sealing the through hole. The third orifices substantially communicate the gap, which is provided between the inner wall of the through hole and the external wall of the liquid pouring tube, to atmospheric air. It should be noted that, as explained above, this gap can ventilate the internal space of the bag.

The sealing means is a cap, in which the cap includes a cap body and a bushing, the cap body screwing to the cover, the bush protruding to an inside of the cap body, and in which the bushing includes an O-ring which adheres to the surface of the collar portion to seal ventilation from the fluid passage. The sealing means including this O-ring makes it possible to prevent both liquid and gas from flowing out of the mouth portion.

Moreover, when the sealing means is removed, the gas in the outer container and the gas in the bag escape through the first and second ventilating means, respectively, to the outside of the mouth portion, before the liquid in the liquid pouring tube is drained to the mouth portion. This makes it possible to prevent the liquid in the liquid pouring tube from being drained to the outside of the mouth portion.

The fluid container according to the first aspect of the invention is totally different from the conventional structure according to Patent Document 1. The fluid container according to the first aspect of the present invention does not include an equivalent of "a coupling 724" at the top edge of "a liquid pouring tube 722" as well as an equivalent of "a void space 776" residing at the top edge of "a coupling 724" which is "the void space 776 connected to a fluid passage 780 of the liquid pouring tube 722 in Patent Document 1 (see FIG. 5 and FIG. 6).

In the case of the conventional fluid container according to Patent Document 1, the gas in the liquid pouring tube and the gas in the bag communicate each other through the void space. Accordingly, even if the inside of the outer container is pressurized and the bag shrinks, the pressure in the liquid pouring tube and the pressure in the bag corresponded with each other. Therefore, when the sealing means is removed, the gas in the outer container and the gas in the bag escape through the void space to the outside, before the liquid in the liquid pouring tube is drained to the mouth portion.

On the other hand, in the liquid container according to the first aspect of the present invention, the gas in the liquid pouring tube, the gas in the outer container and the gas in the bag are sealed individually by way of the sealing means. When the sealing means is removed, the pressure in the liquid pouring tube, the pressure in the outer container and the pressure in the bag promptly correspond with atmospheric pressure. This makes it possible to prevent the liquid in the liquid pouring tube from being drained to the outside of the mouth portion.

The fluid container according to the first aspect of the present invention is configured such that the liquid pouring tube having the collar portion can be attached to the mouth portion of the outer container through the retainer. This makes it possible to easily attach the liquid pouring tube without depending upon the adjustment of force to be applied by the operator.

In a second aspect of the liquid container as described in the first aspect of the present invention, the liquid pouring tube joins a tube in the middle from the first end having the collar portion to the second end.

For example, it is possible to heat weld the liquid pouring tube to the tube in the middle from the first end having the collar portion to the second end, by means of ultrasonic oscillation. In the case of the liquid container according to the first aspect of the present invention, the liquid pouring tube is integrated into the main body. This makes it possible to save the trouble of eliminating chemicals seeping into the gaps of press fit points of the liquid pouring tube as a conventional separate body.

In a third aspect of the liquid container as described in the first or second aspect of the present invention, when a pressurized fluid is supplied between the bag and the outer container, liquid is distributed from the bag through a fluid passage of the liquid pouring tube.

In a fourth aspect of the liquid container as described in any one of the first to third aspects of the present invention, a toric cover is threaded in the mouth portion, in which the toric cover holds the neck portion and the retainer to the mouth portion.

In a fifth aspect of the liquid container as described in the fourth aspect of the present invention, the sealing means is a cap, in which the cap includes a cap body and a bushing, the cap body screws to the cover and having a light blocking effect, the bushing protrudes to an inside of the cap body and has corrosion resistance, and in which the bushing includes an O-ring that adheres to the surface of the collar portion to seal ventilation from the fluid passage.

The cap body preferably consists of a metal body, and a female screw threaded to the cover is provided to the inner circumference of the cap body. When the cap is closed, the inner wall of the cap body abuts the top face of the retainer. The cap body has a light blocking effect so that chemicals (e.g., a developing solution) accommodated in the bag do not chemically change. Since there is a high possibility that the bushing makes contact with the chemicals accommodated in the bag, it is preferable that the bushing be consisted of synthetic resins with corrosion resistance. For example, a first, end of the bushing is pressed into the cap body, thereby integrating the bushing and the cap body, A second end of the bushing protrudes to the inside of the cap body. The bushing supports the O-ring on the apical surface. The O-ring adheres to the surface of the collar portion, thereby preventing both the liquid and gas from flowing out of the fluid passage.

In a sixth aspect of the liquid container as described in the fifth aspect of the present invention, at least one vent hole is provided to a perimeter of the cap body, and when the threading with the cover is released, gas in the outer container and gas in the bag escape through the first and second ventilating means, respectively, to an outside of the mouth portion, before liquid in the liquid pouring tube is drained to the mouth portion.

In a seventh aspect of the present invention, a liquid container is provided, in which a dispenser is connected to the fluid container, the fluid container including: a flexible bag having a neck portion that is open for making it possible to pour liquid; an outer container that accommodates the bag by supporting the neck portion with a mouth portion; a cylindrical retainer held by the mouth portion, the retainer having a substantially cylindrical header portion protruding from a cylindrical bottom at a first end, a cylindrical portion fitting into an orifice of the neck portion at a second end, and a through hole penetrating from the first end to the second end; a liquid pouring tube having a collar portion adhered to a top face of the header portion at the first end, with the second end being inserted into the through hole, in which the liquid pouring tube has a fluid passage extending from the first end to the second end and liquid in the bag is drained through the fluid passage; a first ventilating means for ventilating gas from an inside of the outer container to the mouth portion, in which the first ventilating means has a plurality of first orifices provided at a bottom of the neck portion, the plurality of first orifices communicating from an inside of the outer container to an inside of the neck portion, and has a plurality of second orifices communicating from a perimeter of the cylindrical portion to the top face of the header portion; and a second ventilating means for ventilating gas from the inside of the bag to the mouth portion, in which the second ventilating means has a plurality of third orifices provided at the collar portion, the plurality of third orifices communicating from the mouth portion to an inside of the through hole, the dispenser including: a cylindrical outer cylinder; a valve mechanism, which is held in a state where axial advance and retreat are possible inside the outer cylinder, and which has a duct that is open and closable; a sleeve, which is held around an outer perimeter of an orifice side of the outer cylinder, and which has a releasably lockable locking mechanism to cover the header portion; and a means for receiving liquid distributed from the bag through a fluid passage of the liquid pouring tube and the duct of the valve mechanism, in which the valve mechanism is biased to and adheres to the first end of the liquid pouring tube.

According to the seventh aspect of the present invention, the fluid container is connected with a dispenser, and the fluid container includes a flexible bag and an outer container. The bag has a neck portion that is open for making it possible to pour liquid. The outer container makes it possible to accommodate the bag with the neck portion supported by a mouth portion.

Moreover, the fluid container according to the seventh aspect of the present invention includes a cylindrical retainer and a liquid pouring tube. The retainer is held at the mouth portion. Moreover, the retainer has a substantially cylindrical header portion at the first end, and has a cylindrical portion at the second end. In addition, the retainer has a through hole penetrating from the first end to the second end. The header portion protrudes from within a cylindrical bottom of the retainer. The cylindrical portion fits in the orifice of the neck portion. The liquid pouring tube has, in the first end thereof, a collar portion adhered to a top face of the header portion. Moreover, the second end of the liquid pouring tube is inserted into the through hole of the retainer. The liquid pouring tube has a fluid passage extending from the first end to the second end, and the liquid in the bag is drained through the fluid passage.

On the other hand, in the case of the fluid container according to the seventh aspect of the present invention, the dispenser includes a socket main body, a valve mechanism, and a sleeve. The socket main body has a cylindrical outer cylinder. The valve mechanism is constructed inside the socket main body, and causes the axially penetrating duct to be open and closable. The sleeve is held on the outer perimeter of the orifice side of the socket main body. Moreover, the sleeve has a releasably lockable locking mechanism so as to cover the header portion. In addition, the dispenser includes a means for receiving liquid distributed from the bag through a fluid passage of the liquid pouring tube and the duct of the valve mechanism, in which the valve mechanism is biased to and adheres to the first end of the liquid pouring tube.

For example, the valve mechanism may include a valve arranged in the duct, an inner sleeve, a helical compression spring, and a coupling seat. The valve is arranged in the duct, and has a valve at the tip end, and the bottom is fixed to the socket main body. As for the inner sleeve, the inside forms a portion of the duct, and a shank forms a retractable bellows. Furthermore, a first end of the inner sleeve has a seat portion open and closable by the valve, and a second end of the inner sleeve fixed to the socket main body. The helical compression spring applies a force so that the inner sleeve extends. The coupling seat bonds to the side of the seat portion of the inner sleeve, and is biased to and adheres to the first end of the liquid pouring tube. The locking mechanism may be, as described later, a so-called ball catch using balls as a locking element, and the sleeve releasably engages with the header portion of the retainer so as to cover it.

As for the dispenser, the duct in the valve mechanism is usually blocked with the seat portion abutting the valve. When the socket main body is inserted into the retainer, the valve mechanism is biased to the first end of the liquid pouring tube and adheres to the top face of the liquid pouring tube. In addition, when the socket main body is inserted, the seat portion separates from the valve, whereby the duct in the valve mechanism becomes passable. In a state where the sleeve is locked to the header portion, the fluid passage of the liquid pouring tube couples directly to the duct of the valve mechanism, thereby making it possible to receive liquid distributed from the bag.

The fluid container according to the seventh aspect of the present invention does not use the breakable seal shown in Patent Document 1. Therefore, it is possible to avoid a case in which the probe provided to the dispenser breaks through the seal, causing seal fracture pieces to mix into the bag. Moreover, a concern is eliminated regarding a case in which an operator can not properly break through the seal, causing the clogging of the probe, thereby breaking the connection. In this way, the liquid container according to the seventh aspect of the present invention makes it possible to connect the dispenser to the container without the use of a breakable seal.

In an eighth aspect of the liquid container as described in the seventh aspect of the present invention, the liquid pouring tube joins a tube in the middle from a first end having the collar portion to a second end.

In a ninth aspect of the liquid container as described in the seventh or eighth aspect of the present invention, the dispenser communicates with a second orifice of the first ventilating means, and a gas passage, to which a pressurized fluid is supplied, is provided between the outer cylinder and the valve mechanism.

The gas passage may be a plurality of slits formed in the inner wall of the outer cylinder of the socket main body. Regarding these slits in a locked state, a first end of each communicates with the second orifices of the first ventilating means, and a second end of each is connected to a supply port provided to the dispenser.

In a tenth aspect of the liquid container as described in the ninth aspect of the present invention, when a pressurized fluid is supplied between the bag and the outer container through the gas passage, the bag shrinks and liquid is distributed from the bag through a fluid passage of the liquid pouring tube and the duct of the valve mechanism.

The fluid container according to the present invention is configured such that the liquid pouring tube having the collar portion can be attached to the mouth portion of the outer container through the retainer. This makes it possible to easily attach the liquid pouring tube independent of the force applied by the operator for adjustment. The liquid container is configured such that the duct provided in the dispenser can be directly connected to the fluid passage of the liquid pouring tube, thereby making it possible to easily connect the dispenser to the container.

DETAILED DESCRIPTION OF THE INVENTION

In the following, the most preferred embodiments of the present invention are described with reference to the drawings.

Figure 1:
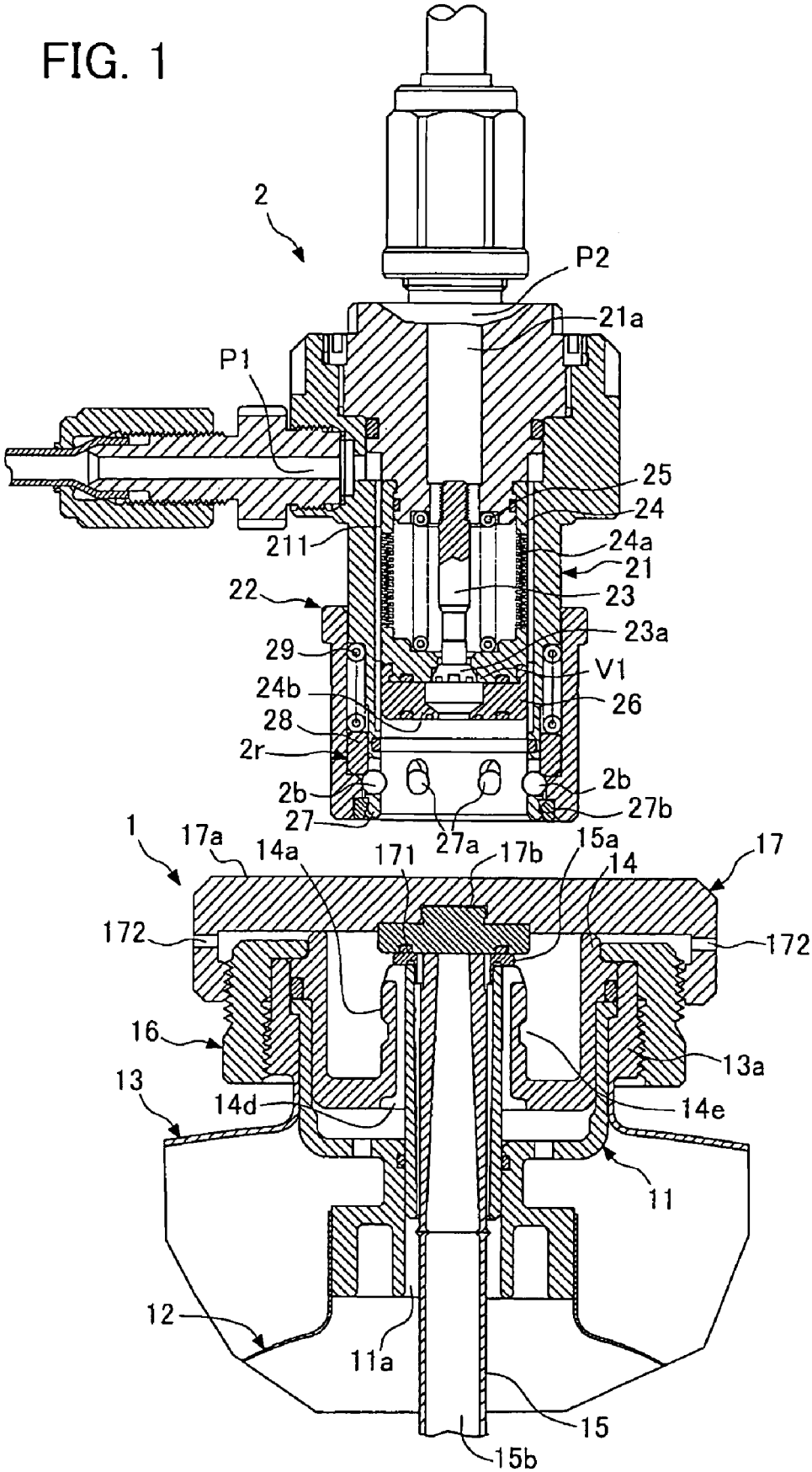
FIG. 1 is a longitudinal section representing an embodiment of a fluid container of the present invention, showing a top end and a dispenser of the container.
Figure 2:
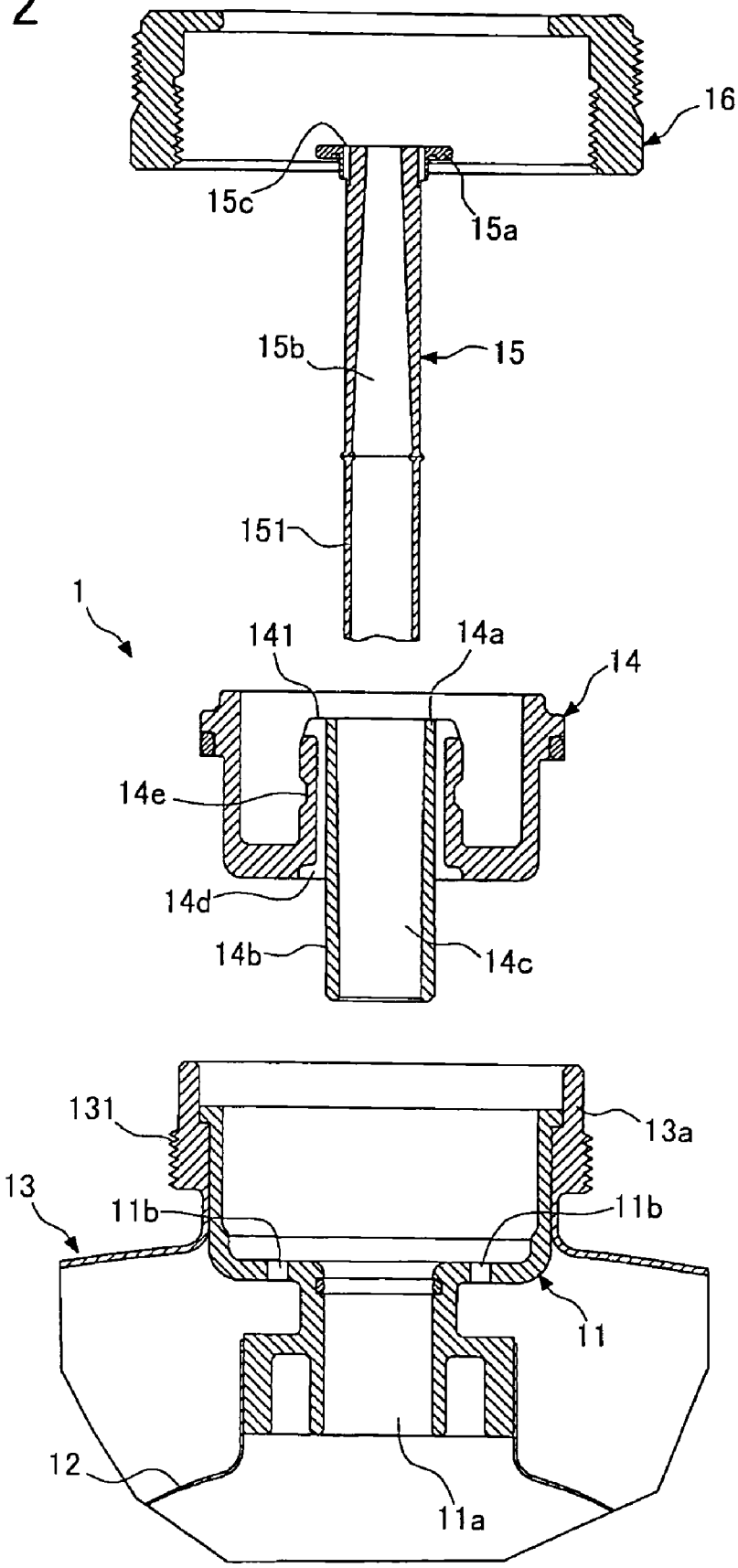
FIG. 2 is a cross-sectional exploded view of the top end of the container according to the embodiment.
Figure 3:
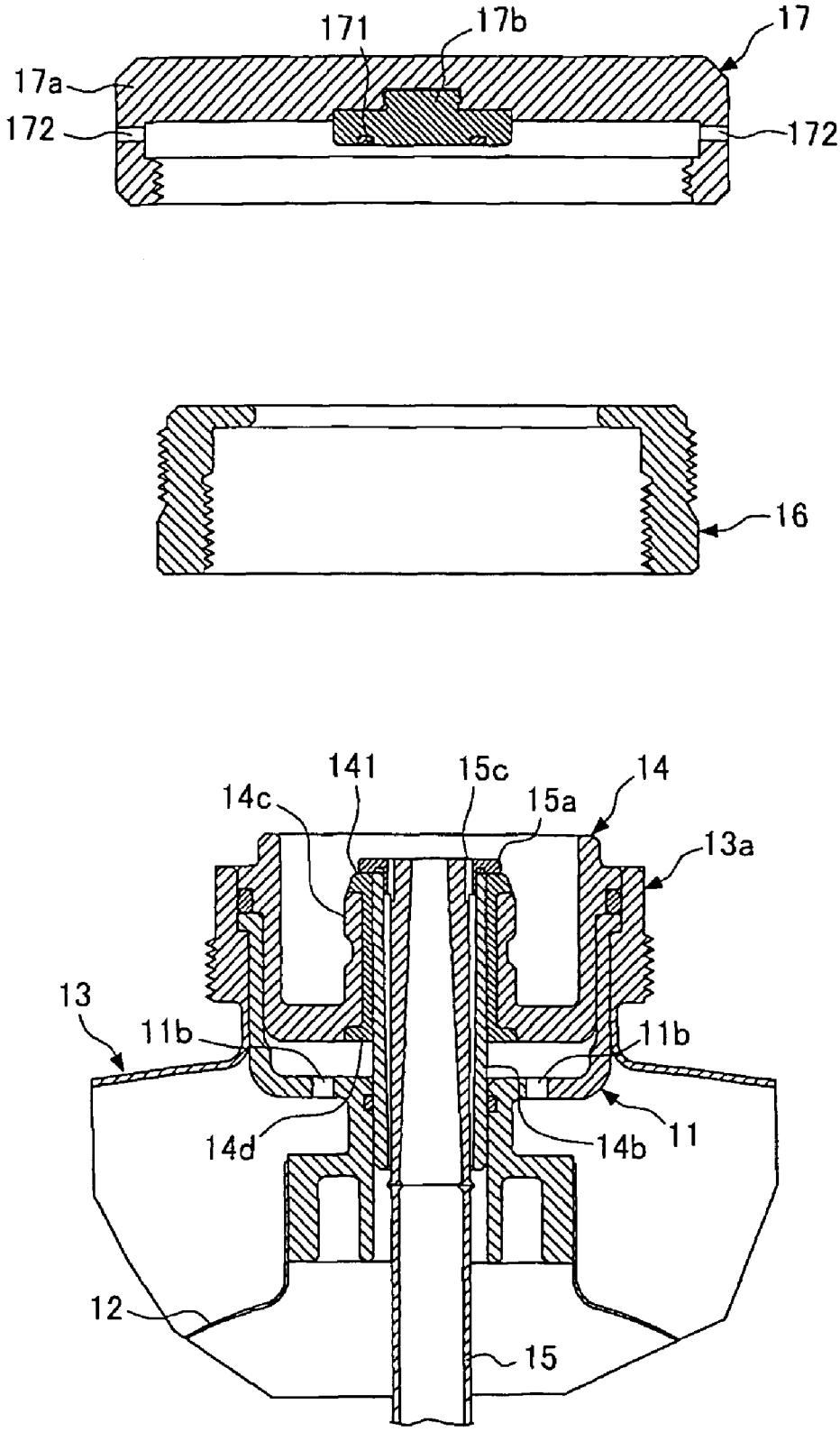
FIG. 3 is a cross-sectional exploded view of the container according to the embodiment, showing the top end and dispenser of the container.
Figure 4:
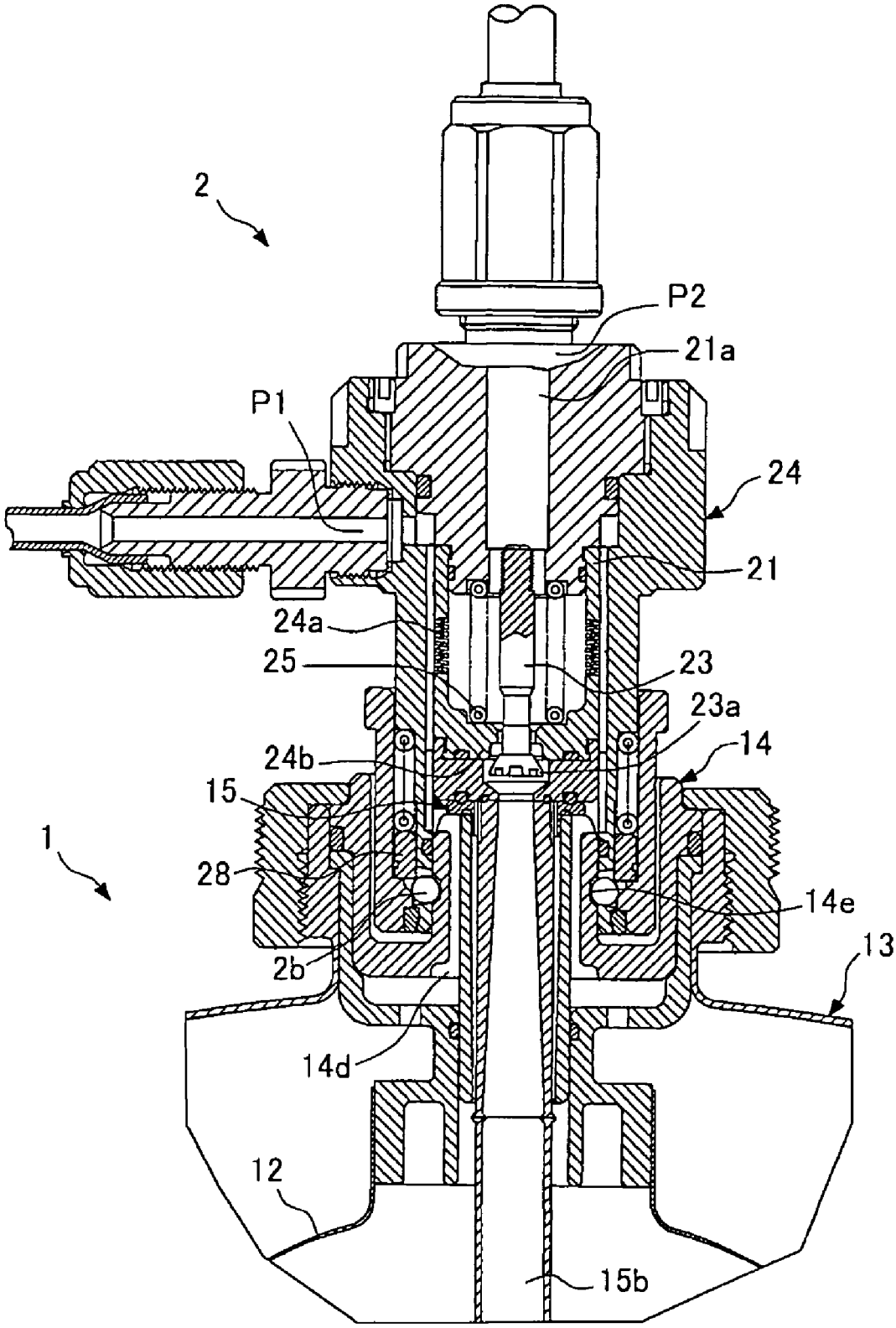
FIG. 4 is a longitudinal section of the container according to the embodiment, showing an assembled container and dispenser.
Figure 5:
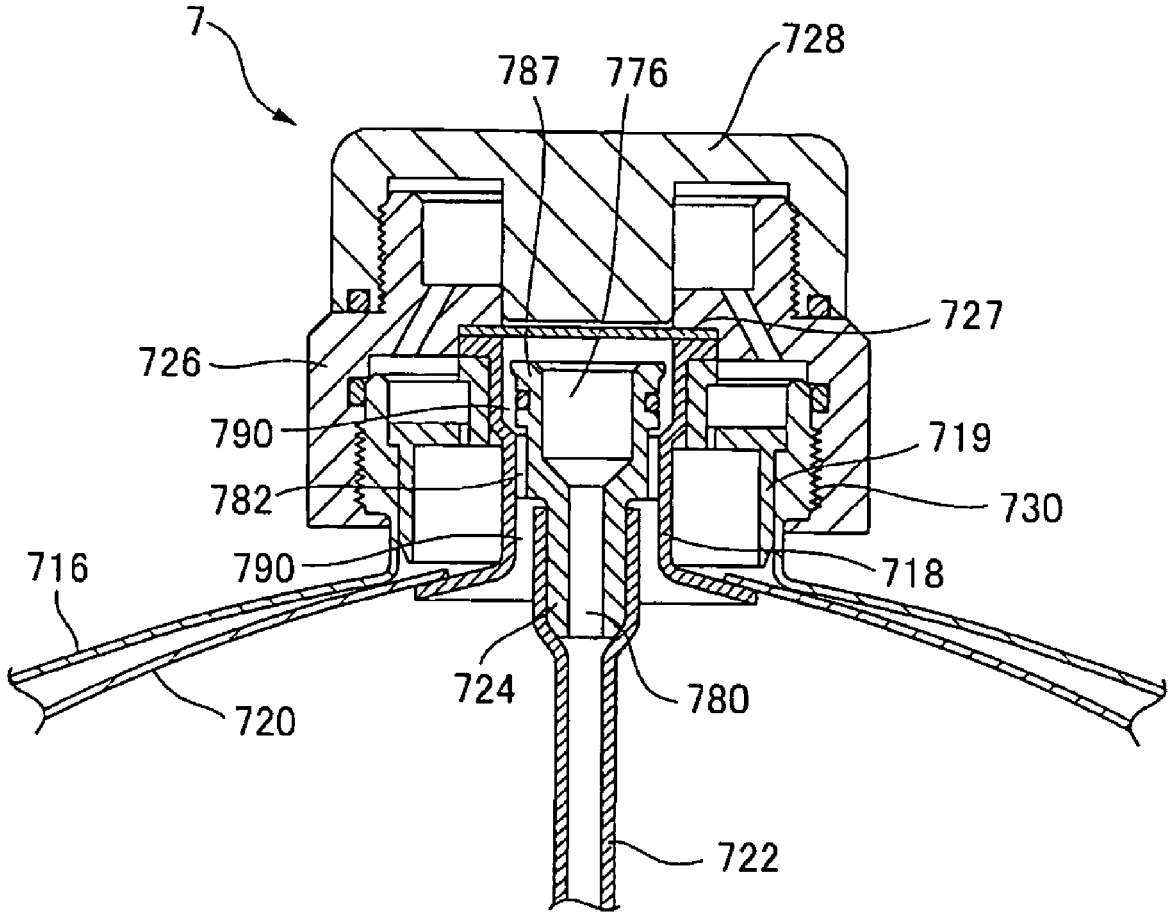
FIG. 5 is a cross-sectional view of the top end of the container according to the prior art, in a state where a cap is attached.
Figure 6:
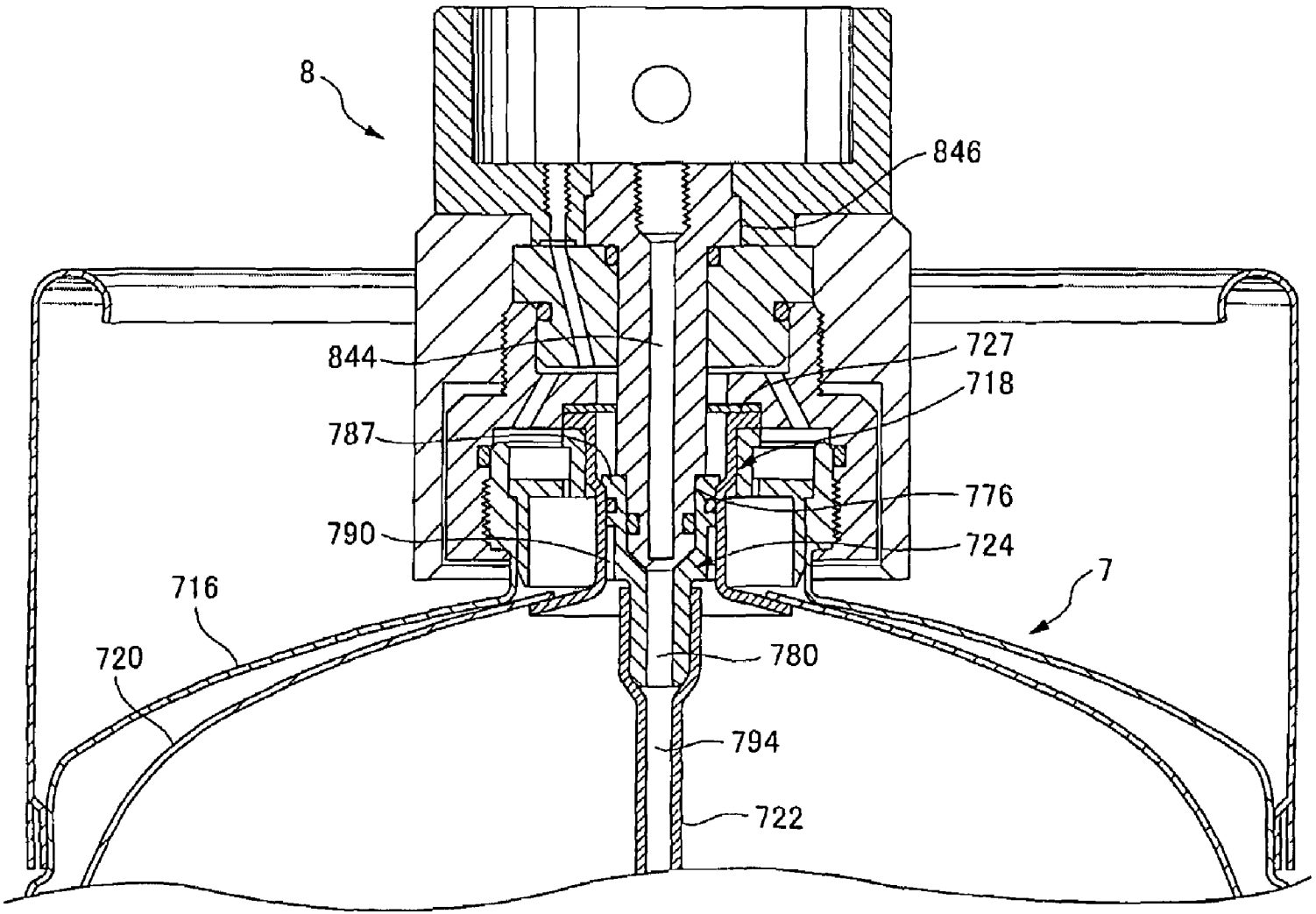
FIG. 6 is a cross-sectional view of the top edge of the container according to the prior art, in a state where the container and the dispenser are assembled.

FIG. 1 is a longitudinal section representing an embodiment of a fluid container (hereinafter referred to as a container) of the present invention, showing a top end and a dispenser of the container. FIG. 2 is a cross-sectional exploded view of the top end of the container according to the embodiment. FIG. 3 is a cross-sectional exploded view of the container according to the embodiment, showing the top end and dispenser of the container. FIG. 4 is a longitudinal section of the container according to the embodiment, showing an assembled container and dispenser.

First, a configuration of a container according to the present invention is explained. In FIG. 1, a container 1 includes a flexible bag 12 and an outer container 13. The bag 12 has a neck portion 11 that is open for making it possible to pour liquid. The outer container 13 makes it possible to accommodate the bag 12 with the neck portion 11 supported by a mouth portion 13*a*.

In FIG. 1 or FIG. 2, the bag 12 is configured with a pouch of a flexible film formed with an inert material and the neck portion 11 consisting of relatively rigid synthetic resins, in which the neck portion 11 is bonded to an end portion of the pouch of the flexible film. The bag 12 is washed in advance, and is accommodated to the outer container 13. After draining the liquid from the bag 12, the bag 12 with the neck portion 11 is discarded, and a new bag 12 with the neck portion 11 is accommodated in the outer container 13. The fluid container according to the present invention is a dual storage system-type container, in which the outer container is repeatedly used, and in which a new bag is used each time.

In FIG. 1 or FIG. 2, a steel drum is preferably used as the outer container 13, the steel drum being configured with a base plate, a side wall with a ring, and a top plate that bulges in the middle thereof (none of these are shown). As for the outer container 13, an external thread 131 is formed on the mouth portion 13*a*, and a pair of molded handles (not shown) may be provided thereto to facilitate transport.

As shown in FIG. 2, a flange is formed to an orificial side of the neck portion 11, while a step is provided to an inner wall of the mouth portion 13*a*, and this flange engages with the step, thereby supporting the neck portion 11 to the mouth portion 13*a*. The bag 12 is accommodated to the outer container 13, the neck portion 11 attached to the bag 12 is supported by the mouth portion 13*a* of the outer container 13, and thereafter the bag 12 is expanded preferably with nitrogen or compressed air. Subsequently, liquid is poured through an orifice 11*a* of the neck portion 11 into the bag 12 (see FIG. 2).

The container according to the present invention includes a retainer 14 and a liquid pouring tube 15 (see FIG. 2). In FIG. 2, the retainer 14 is held by the mouth portion 13*a*. Moreover, the retainer 14 has a substantially cylindrical header portion 14*a* in a first end, and has a cylindrical portion 14*b* in a second end. In addition, the retainer 14 has a through hole 14*c* penetrating from the first end to the second end. The header portion 14*a* protrudes from a base of the retainer 14. The cylindrical portion 14*b* fits in the orifice of the neck portion 11 (see FIG. 3).

In FIG. 2, the liquid pouring tube 15 has, in the first end thereof, a collar portion 15*a* adhered to a top face 141 of the header portion 14*a*. Moreover, the second end of the liquid pouring tube 15 is inserted into the through hole 14*c* of the retainer 14. The liquid pouring tube 15 has a fluid passage 15*b* extending from the first end to the second end, and the liquid in the bag 12 is drained through the fluid passage 15*b* (see FIG. 1).

In FIG. 2, the external diameter of the retainer 14 is slightly smaller than the inner diameter of the neck portion 11, and the retainer 14 fits in the neck portion 11 supported by the mouth portion 13*a* (see FIG. 3). A flange, which has an external diameter which is slightly smaller than the inner diameter of the mouth portion 13*a*, is provided to a first end of the retainer 14, and an O-ring is supported by this flange, thereby sealing up the mouth portion 13*a* (see FIG. 3).

A cover 16 is fastened to the mouth portion 13*a*, thereby holding the retainer 14 in the mouth portion 13*a* together with the neck portion 11 (see FIG. 1). A predetermined gap is provided between a bottom external wall of the retainer 14 and a bottom inner wall of the mouth portion 13*a*. As a result, it is possible to ventilate gas between a plurality of first orifices 11*b* provided at the bottom of the neck portion 11 and a plurality of second orifices 14*d* provided to the retainer 14 (see FIG. 2).

In FIG. 2, the cylindrical portion 14*b* protrudes from the bottom of the retainer 14, and the cylindrical portion 14*b* fits in the orifice 11*a* of the neck portion 11. An O-ring is supported inside the orifice 11*a* of the neck portion 11, and this O-ring adheres to the outer perimeter of the cylindrical portion 14*b*, thereby making it possible to seal the gas in the bag 12 (see FIG. 3). The through hole 14*c* penetrates from the top edge of the header portion 14*a* to the bottom edge of the cylindrical portion 14*b*, and the liquid pouring tube 15 is inserted into the through hole 14*c* (see FIG. 3). In order to make it possible to ventilate gas through a plurality of third orifices 15*c*, a gap is provided between the through hole 14*c* and the outer perimeter of the liquid pouring tube 15 (see FIG. 3).

The container according to the present invention includes a first ventilating means for ventilating air from the inside of the outer container 13 to the mouth portion 13*a*; a second ventilating means for ventilating air from the inside of the bag 12 to the mouth portion 13*a*; and a sealing means for sealing the mouth portion 13*a*. In FIG. 2, the first ventilating means has the plurality of first orifices 11*b* and the plurality of second orifices 14*d*. The plurality of first orifices 11*b* is provided at the bottom of the neck portion 11 and communicates the inside of the outer container 13 to the inside of the neck portion 11. The plurality of second orifices 14*d* communicates the perimeter of the cylindrical part 14*b* to the top face 141 of the header portion 14*a*. The second ventilating means has the plurality of third orifices 15*c*. The plurality of third orifices 15*c* are provided to the collar portion 15*a* of the liquid pouring tube 15, and communicate the mouth portion 13*a* to the inside of the through hole 14*c* of the retainer 14 (see FIG. 3).

The container according to the present invention prevents, when the sealing means is attached thereto, both liquid and gas from flowing out of the mouth portion 13*a*. Moreover, when the sealing means is removed, the liquid in the outer container 13 and the gas in the bag 12 escape through the first and second ventilating means, respectively, to the outside, before the liquid in the liquid pouring tube 15 is drained to the mouth portion 13*a*.

As shown in FIG. 2, the first orifices 11*b* are through holes formed at the bottom of the neck portion 11, and are provided around the orifices 11*a* of the neck portion 11 into which the cylindrical portion 14*b* is inserted. The first orifices 11*b* substantially communicate the internal space of the outer container 13 to the gap provided between the retainer 14 and the mouth portion 13*a* (see FIG. 3). The second orifices 14*d* may be slits penetrating from the perimeter of the cylindrical portion 14*b* to the top face 141 of the header portion 14*a*, and are provided between the cylindrical portion 14*b* and the header portion 14*a*. The second orifices 14*d* substantially communicate the gap, which is provided between the retainer 14 and the neck portion 11, to atmospheric air (see FIG. 3).

As shown in FIG. 2, the third orifices 15*c* are through holes formed at the collar portion 15*a* of the liquid pouring tube 15, and penetrate from the top surface of the collar portion 15*a* to the perimeter of the tube. In FIG. 2, the O-ring is supported on the under surface of the collar portion 15*a*, and this O-ring adheres to the top face 141 of the header portion 14*a*, thereby sealing the through hole 14*c*. The third orifices 15*c* substantially communicate the gap, which is provided between the inner wall of the through hole 14*c* and the external wall of the liquid pouring tube 15, to atmospheric air (FIG. 3 see). As explained above, this gap can ventilate the internal space of the bag 12.

In FIG. 1 and FIG. 3, the sealing means is a cap 17 threading to the cover 16 that is provided to the mouth portion 13*a*, and the cap 17 consists of a cap body 17*a*, which threads to the cover 16 and which has a light blocking effect, and a bushing 17*b*, which protrudes to the inside of the cap body 17*a* and has corrosion resistance. The bushing 17*b* includes an O-ring 171, which adheres to the surface of the collar portion 15*a* and seals ventilation from the fluid passage 15*b*.

In FIG. 1, the cap body 17*a* consists of a metal body, and a female screw threading to the cover 16 is provided to the inner circumference of the cap body 17*a*. When the cap 17 is closed, the inner wall of the cap body 17*a* abuts the top face of the retainer 14. The cap body 17*a* has a light blocking effect so that chemicals accommodated in the bag 12 do not chemically change. Since there is a high possibility that the bushing 17*b* contacts with the chemicals accommodated in the bag 12, it is preferable that the bushing 17*b* consist of synthetic resins with corrosion resistance. A first end of the bushing 17*b* is pressed into the cap body 17*a*, thereby integrating the bushing 17*b* and the cap body 17*a* (see FIG. 3). A second end of the bushing 17*b* protrudes to the inside of the cap body 17*a*, thereby supporting the O-ring 171 on the apical surface. The O-ring 171 adheres to the surface of the collar portion 15*a*, thereby preventing both the liquid and gas from flowing out of the fluid passage 15*b*.

Moreover, at least one vent hole 172 is provided to the perimeter of the cap body 17*a*. Accordingly, when the threading with the cover 16 is released, the gas in the outer container 13 and the gas in the bag 12 escape through the first and second ventilating means, respectively, to the outside of the mouth portion 13*a*, before the liquid in the liquid pouring tube 15 is drained to the mouth portion 13*a* (see FIG. 1 or FIG. 3). In this way, the vent holes 172 are provided to the perimeter of the cap body 17*a*. Accordingly, when the cap 17 is loosened, the adhesion of the O-ring 171 to the surface of the collar portion 15*a* is released, thereby exhausting the gas in at least the plurality of third orifices 15*c* through the vent holes 172 to the outside. This makes it possible to prevent the liquid in the liquid pouring tube 15 from spouting out.

In FIG. 1, when the cap 17 is removed, the gas in the outer container 13 and the gas in the bag 12 escape through the first and second ventilating means, respectively, to the outside of the mouth portion 13*a*, before the liquid in the liquid pouring tube 15 is drained to the mouth portion 13*a*. This makes it possible to prevent the liquid in the liquid pouring tube 15 from being drained to the outside of the mouth portion 13*a*.

In the container according to the present invention, the gas in the liquid pouring tube 15, the gas in the outer container 13 and the gas in the bag 12 are individually sealed with the cap 17. When the cap 17 is removed, the pressure in the liquid pouring tube 15, the pressure in the outer container 13 and the pressure in the bag 12 promptly correspond with atmospheric pressure. This makes it possible to prevent the liquid in the liquid pouring tube 15 from being drained to the outside of the mouth portion 13*a*.

Moreover, as shown in FIG. 2, the liquid pouring tube 15 joins a tube 151 in the middle from the first end having the collar portion 15*a* to the second end. It is possible to heat weld the liquid pouring tube 15 to the tube 151 in the middle from the first end having the collar portion 15*a* to the second end, by means of ultrasonic oscillation. In the case of the container according to the present invention, the liquid pouring tube 15 is integrated into the main body. This makes it possible to save the trouble of eliminating chemicals seeping into the gaps of press fit points of the liquid pouring tube as a conventional separate body.

In the case of the container according to the present invention, it is possible to distribute the liquid in the container by removing the cap and connecting the dispenser. In FIG. 1, a dispenser 2 includes a socket main body 21, a valve mechanism V1, and a sleeve 22. The socket main body 21 has a cylindrically shaped outer cylinder. The valve mechanism V1 is constructed inside the socket main body 21, and intermittently causes the duct 21*a* to axially penetrate. The sleeve 22 is held on the outer perimeter of the orifice side of the socket main body 21. Moreover, the sleeve has a releasably lockable locking mechanism 2*r* so as to cover the header portion 14*a*. In addition, the dispenser 2 includes a means to receive liquid distributed from the bag 12 through the fluid passage 15*b* of the liquid pouring tube 15 and the duct 21*a* of the valve mechanism V1, in which the valve mechanism V1 is biased to and adheres to the first end of the liquid pouring tube 15 (see FIG. 4).

In FIG. 1, the valve mechanism V1 includes a valve 23 arranged in the duct 21*a*, an inner sleeve 24, a helical compression spring 25, and a coupling seat 26. The valve 23 is arranged in the duct 21*a*, and has a valve 23*a* at the tip end, and the bottom is fixed to the socket main body 21. Regarding the inner sleeve 24, the inside forms a part of the duct 21*a*, and a shank 24*a* forms a retractable bellows. A second end of the inner sleeve 24 has a seat portion 24*b* that makes the valve 23*a* open and close, and a second end of the inner sleeve 24 is fixed to the socket main body 21. The helical compression spring 25 applies a force so that the inner sleeve 24 extends. The coupling seat 26 bonds to the side of the seat portion 24*b* of the inner sleeve 24, and is biased to and adheres to the first end of the liquid pouring tube 15. The locking mechanism 2*r* may be, as described later, a so-called ball catch using balls 2*b* as a locking element, and the sleeve 22 releasably engages with the header portion 14*a* of the retainer 14 so as to cover it (see FIG. 4).

As shown in FIG. 1, regarding the dispenser 2, the duct 21*a* in the valve mechanism V1 is usually blocked with the seat portion 24*b* abutting the valve 23*a*. When the socket main body 21 is inserted into the retainer 14, the valve mechanism V1 is biased to the first end of the liquid pouring tube 15 and adheres to the top face of the liquid pouring tube 15. In addition, when the socket main body 21 is inserted, the seat portion 24*b* separates from the valve 23*a*, whereby the duct 21*a* in the valve mechanism V1 becomes passable (see FIG. 4). In a state where the sleeve 22 is locked to the header portion 14*a*, the fluid passage 15*b* of the liquid pouring tube 15 couples directly to the duct 21*a* of the valve mechanism V1, thereby making it possible to receive liquid distributed from the bag 12.

The fluid container according to the present invention does not use the breakable seal shown in Patent Document 1. Thus, it is possible to avoid a case in which the probe provided to the dispenser breaks through the seal, causing the seal fracture pieces to mix into the bag. Moreover, a concern is eliminated regarding a case in which an operator can not properly break through the seal, causing clogging of the probe, disabling the connection. In this way, the container according to the present invention achieves a joint structure with which the dispenser is connected to the container, without the use of the breakable seal.

In FIG. 1, the dispenser 2 communicates with the second orifices 14*d* of the first ventilating means (see FIG. 4), and a gas passage 211, to which pressurized fluid is supplied, is provided between the socket main body 21 and the valve mechanism V1. The gas passage 211 is a plurality of slits formed in the inner wall of the outer cylinder of the socket main body 2. Regarding these slits in a locked state, a first end of each communicates with the second, orifices 14*d* of the first ventilating means, and the second end of each is connected to a supply port P1 provided to the dispenser 2. When a pressurized fluid is supplied between the bag 12 and the outer container 13 through the gas passage 211, the bag 12 shrinks and the liquid is distributed from the bag 12 to a discharge port P2 through the fluid passage 15*b* of the liquid pouring tube 15 and the duct 21*a* of the valve mechanism V1.

In FIG. 1, the locking mechanism 2*r* includes the plurality of balls 2*b*, a ball retainer 27, and a slide ring 28. The plurality of balls 2*b* is arranged in the inner circumference of the orifice side of the sleeve 22. The ball retainer 27 holds the plurality of balls 2*b*. Moreover, the ball retainer 27 is provided with a plurality of fitting holes 27*a* permitting only movement in which the plurality of balls 2*b* axially move as well as move outward and inward in the outer perimeter direction. The slide ring 28 is arranged between the socket main body 21 and the sleeve 22. The slide ring 28 biases the plurality of balls 2*b* to the orifice side of the sleeve 22, thereby pressing the plurality of balls 2*b* to the direction in which the diameter reduces. A circular locking groove 14*e*, which locks the plurality of balls 2*b*, is provided to the header portion 14*a* of the retainer 14, thereby releasably connecting the dispenser 2 to the container 1.

In FIG. 1, the ball retainer 27 is configured with a portion of the socket main body 21. The plurality of balls 2*b* is held between the ball retainer 27 and the sleeve 22. The ball retainer 27 and the sleeve 22 are coupled each other with a clip ring 27*b* to avoid separation thereof. Moreover, a step is provided to the external wall of the socket main body 21, and this step is surrounded by the sleeve 22, thereby making it possible to accommodate, in the step, the slide ring 28 and a helical compression spring 29 that biases the slide ring 28.

As shown in FIG. 1, a portion of the plurality of balls 2*b* usually protrudes from each of the fitting holes 27*a*. When the socket main body 21 is inserted into the retainer 14, the plurality of balls 2*b* is guided by the respective fitting holes 27*a* to retract. In conjunction with the retracting of the plurality of balls 2*b*, the slide ring 28 also retracts. When the slide ring 28 retracts a predetermined distance, the plurality of balls 2*b* move to the space from which the slide ring 28 has evacuated. That is, the plurality of balls 2*b* move to the direction in which the diameter increases, and a portion of the plurality of balls 2*b* evacuates from each of the fitting holes 27*a*. When arriving at the circular locking groove 14*e*, the plurality of balls 2*b* is biased by the slide ring 28, and fit into the locking groove 14*e* in a locked state (see FIG. 4). It is possible to separate the dispenser 2 from the container 1 by pulling the dispenser 2 with a strong force that causes the plurality of balls 2*b* to overcome the locking groove 14*e*.

In this way, the fluid container according to the present invention enables a one-touch connection of the fluid container, without threading the dispenser as in the case of the prior art. It may be safe to say that the fluid container according to the present invention achieves a quick connector.

What is claimed is:

1. A fluid container having a flexible bag having a neck portion that is open for pouring liquid; and an outer container that supports the neck portion with a mouth portion and that accommodates the bag, the fluid container further comprising:

a cylindrical retainer held by the mouth portion, the cylindrical retainer having a substantially cylindrical header portion protruding from a cylindrical bottom at a first end, a cylindrical portion fitting into an orifice of the neck portion at a second end, and a through hole penetrating from the first end to the second end;

a liquid pouring tube having a collar portion adhered to a top face of the header portion at a first end, with a second end being inserted into the through hole, wherein the liquid pouring tube has a fluid passage extending from the first end to the second end, and wherein liquid in the bag is drained through the fluid passage;

a first ventilating means for ventilating gas from an inside of the outer container to the mouth portion, wherein the first ventilating means has a plurality of first orifices provided to a bottom of the neck portion, the plurality of first orifices communicating from an inside of the outer container to an inside of the neck portion, and has a plurality of second orifices communicating from a perimeter of the cylindrical portion to the top face of the header portion;

a second ventilating means for ventilating gas from the inside of the bag to the mouth portion, wherein the second ventilating means has a plurality of third orifices provided to the collar portion, the plurality of third orifices communicating from the mouth portion to an inside of the through hole; and a sealing means for sealing the mouth portion, wherein, when the sealing means is attached, the sealing means prevents both liquid and gas from flowing out of the mouth portion, and when the sealing means is removed, gas in the outer container and gas in the bag escape through the first ventilating means and second ventilating means, respectively, to an outside of the mouth portion, before liquid in the liquid pouring tube is drained to the mouth portion.

2. The fluid container according to claim 1, wherein the liquid pouring tube joins a middle tube that is distal to the collar portion.

3. The fluid container according to claim 1, wherein, when a pressurized fluid is supplied between the hag and the outer container, liquid is distributed from the bag through a fluid passage of the liquid pouring tube.

4. The fluid container according to claim 1, further comprising a toric cover threaded into the mouth portion, wherein the tonic cover holds the neck portion and the retainer to the mouth portion.

5. The fluid container according to claim 4, wherein the sealing means is a cap, the cap comprises a cap body and a bushing, the cap body threads to the cover and has a light blocking effect, the bushing protrudes to an inside of the cap body and has corrosion resistance, wherein the bushing comprises an O-ring which adheres to the surface of the collar portion to seal ventilation from the fluid passage.

6. The fluid container according to claim 5, wherein at least one vent hole is provided to a perimeter of the cap body, and when the threading with the cover is released, gas in the outer container and gas in the bag escape through the first ventilating means and second ventilating means, respectively, to an outside of the mouth portion, before liquid in the liquid pouring tube is drained to the mouth portion.

7. A fluid container in which a dispenser is connected to the fluid container, the fluid container comprising:

a flexible bag having a neck portion that is open to enable pouring of liquid;

an outer container that accommodates the bag by supporting the neck portion with a mouth portion;

a cylindrical retainer held by the mouth portion, the retainer having a substantially cylindrical header portion protruding from a cylindrical bottom at a first end, a cylindrical portion fitting into an orifice of the neck portion at a second end, and a through hole penetrating from the first end to the second end;

a liquid pouring tube having a collar portion adhered to a top face of the header portion at a first end, with a second end being inserted into the through hole, wherein the liquid pouring tube has a fluid passage extending from the first end to the second end, and wherein liquid in the bag is drained through the fluid passage;

a first ventilating means for ventilating gas from an inside of the outer container to the mouth portion, wherein the first ventilating means has a plurality of first orifices provided to a bottom of the neck portion, the plurality of first orifices communicating from an inside of the outer container to an inside of the neck portion, and has a plurality of second orifices communicating from a perimeter of the cylindrical portion to the top face of the header portion; and a second ventilating means for ventilating gas from the inside of the bag to the mouth portion, wherein the second ventilating means has a plurality of third orifices provided to the collar portion, the plurality of third orifices communicating from the mouth portion to an inside of the through hole, the dispenser comprising:

a cylindrical outer cylinder;

a valve mechanism, which is held in a state where axial advancing and retracting are possible inside the outer cylinder, and which has a duct that is open and closable;

a sleeve, which is held around an outer perimeter of an orifice side of the outer cylinder, and which has a releasably lockable locking mechanism to cover the header portion; and a means for receiving liquid distributed from the bag through a fluid passage of the liquid pouring tube and the duct of the valve mechanism, wherein the valve mechanism is biased to and adheres to the first end of the liquid pouring tube.

8. The fluid container according to claim 7, wherein the liquid pouring tube joins a middle tube that is distal to the collar portion.

9. The fluid container according to claim 7, wherein, the dispenser communicates with a second orifice of the first ventilating means, and a gas passage, to which a pressurized fluid is supplied, is provided between the outer cylinder and the valve mechanism.

10. The fluid container according to claim 9, wherein, when a pressurized fluid is supplied between the bag and the outer container through the gas passage, the bag shrinks and liquid is distributed from the bag through a fluid passage of the liquid pouring tube and the duct of the valve mechanism.

* * * * *